US007181787B2

(12) United States Patent
Wu

(10) Patent No.: US 7,181,787 B2
(45) Date of Patent: Feb. 27, 2007

(54) AIR MATTRESS ASSEMBLY HAVING HEATING DEVICE

(76) Inventor: Shin-Tsai Wu, 1F, No. 19, Alley 3, Lane 106, Sec. 3, Min Chuan East Rd., Taipei (TW)

( * ) Notice: Subject to any disclaimer, the term of this patent is extended or adjusted under 35 U.S.C. 154(b) by 0 days.

(21) Appl. No.: 11/171,425

(22) Filed: Jul. 1, 2005

(65) Prior Publication Data

US 2007/0000050 A1 Jan. 4, 2007

(51) Int. Cl.
*A47C 21/04* (2006.01)

(52) U.S. Cl. ..... 5/421; 5/737; 5/738; 219/212; 219/217

(58) Field of Classification Search ..... 5/421, 5/737, 738; 219/212, 217
See application file for complete search history.

(56) References Cited

U.S. PATENT DOCUMENTS 4,388,738 A * 6/1983 Wagner ..... 5/421
4,423,308 A * 12/1983 Callaway et al. ..... 219/217
4,809,375 A * 3/1989 Bull ..... 5/722
6,568,006 B1 * 5/2003 Hyland ..... 5/421
6,839,922 B1 * 1/2005 Foggett et al. ..... 5/421

* cited by examiner

*Primary Examiner*—Michael Trettel
(74) *Attorney, Agent, or Firm*—Leong C. Lei

(57) ABSTRACT

An air mattress assembly is provided herein, which mainly contains an air mattress, a blanket member, and a mattress cover. The blanket member is laid flatly on top of the air mattress, which contains a heating wire, a cotton blanket, and an insulating cover. The heating wire is layout on and embedded inside the cotton blanket which is in turn wrapped air-tightly inside the insulating cover. A plurality of snap-on devices are configured on a side and along the perimeter of the insulating cover. The mattress cover covers the blanket member and the air mattress, and has a same number of snap-on devices corresponding to those on the blanket member. These snap-on devices join to those on the blanket member so as to position and attach the blanket member to the mattress cover.

4 Claims, 4 Drawing Sheets

AIR MATTRESS ASSEMBLY HAVING HEATING DEVICE

BACKGROUND OF THE INVENTION (a) Technical Field of the Invention

The present invention generally relates to air mattresses, and more particularly to an air mattress assembly having a built-in heating device.

(b) Description of the Prior Art

Air mattresses, due to their easy transportation and storage, have earned their acceptance in the households. In addition, a side benefit of air mattresses is that the air contained in the air mattresses provides a cooling effect to users resting on them. This has contributed air mattresses' wide popularity during hot weather or in places with warm climate. However, this benefit would become a disadvantage when the air mattresses are used during cold weather or in places with cold climate.

Conventionally, an electric blanket could be used to keep the user on the air mattress, or a portion of the air mattress warm, but not the entire air mattress. Most of all, if it is damped, the electric blanket presents a potential hazard of electric shock to the user resting on the air mattress, especially when the user is a senior with urinary incontinence or a child with bedwetting habit.

Accordingly, there is a need for an air mattress capable of raising the temperature of the air contained therewithin so that the air mattress could be applied under all weather conditions.

SUMMARY OF THE INVENTION

The purpose of the present invention is to provide an air mattress assembly, which mainly contains an air mattress, a blanket member, and a mattress cover. The blanket member is laid flatly on top of the air mattress, which contains a heating wire, a cotton blanket, and an insulating cover. The heating wire is laid out on and embedded inside the cotton blanket which is in turn wrapped air-tightly inside the insulating cover. A plurality of snap-on devices are configured on a side and along the perimeter of the insulating cover. The mattress cover covers the blanket member and the air mattress, and has a same number of snap-on devices corresponding to those on the blanket member. These snap-on devices join to those on the blanket member so as to position and attach the blanket member to the mattress cover.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
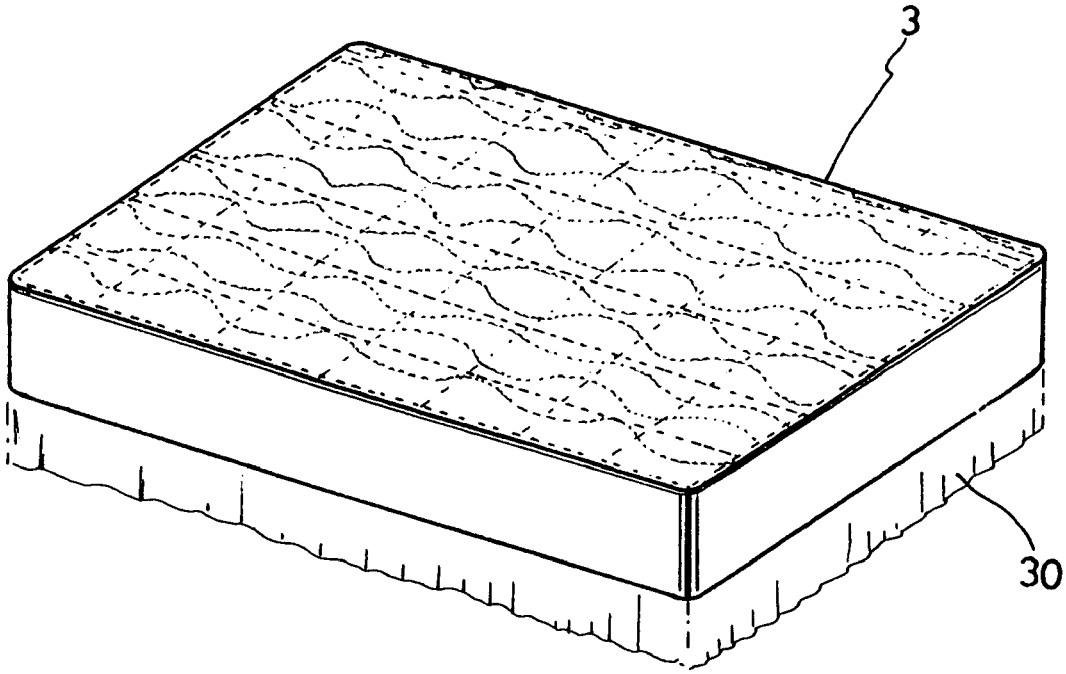
FIG. 1 is a perspective view showing the outlook of an air mattress assembly according to an embodiment of the present invention.
Figure 2:
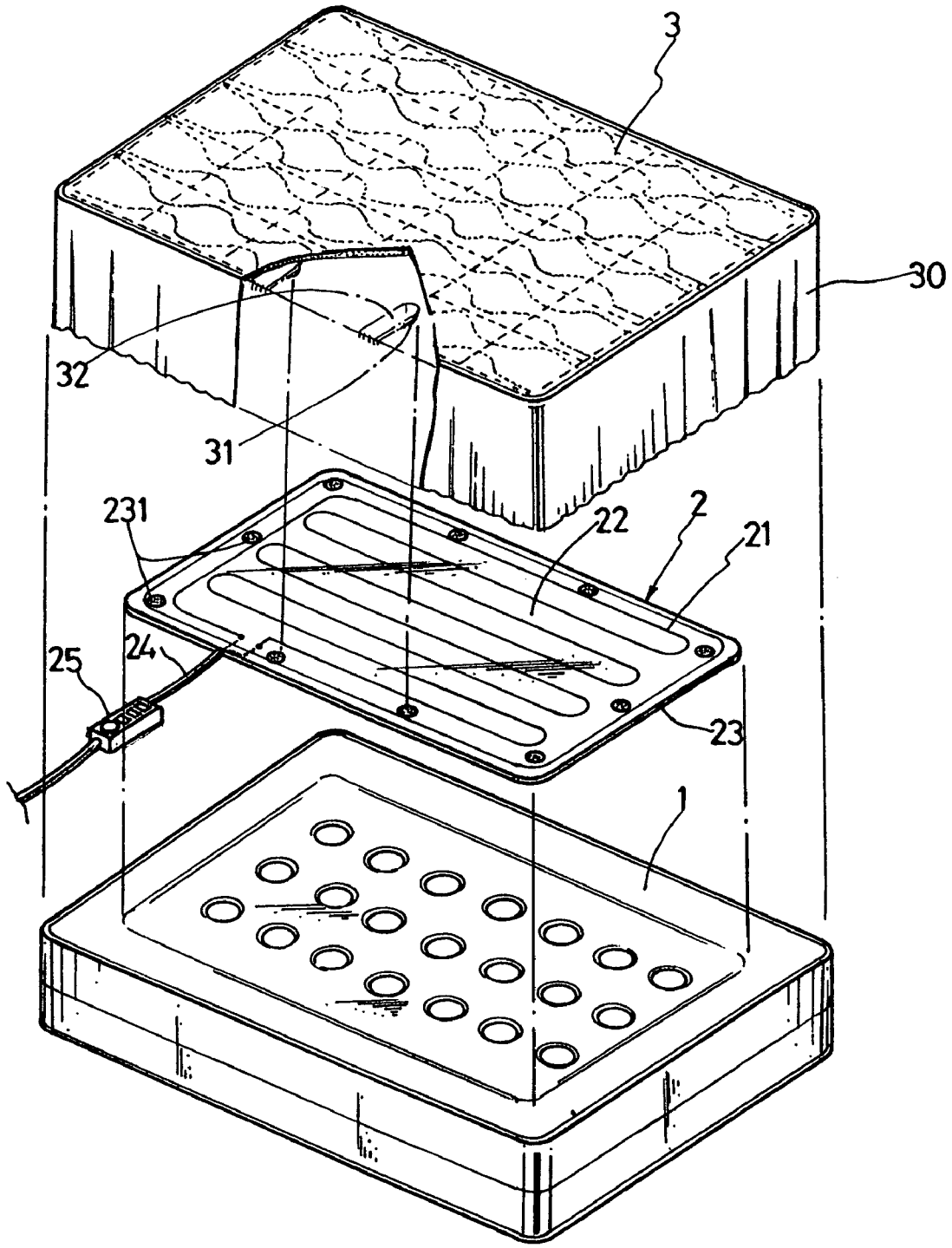
FIG. 2 is a perspective explosion view showing the various components of the air mattress assembly of FIG. 1.
Figure 4:
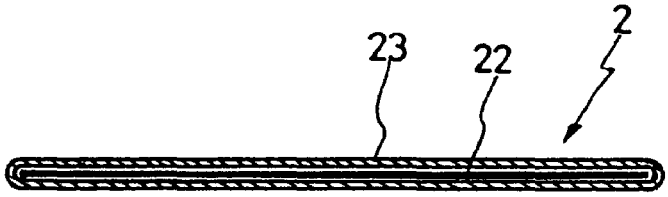
FIG. 4 is a schematic sectional view showing the blanket member of FIG. 2.
Figure 5:
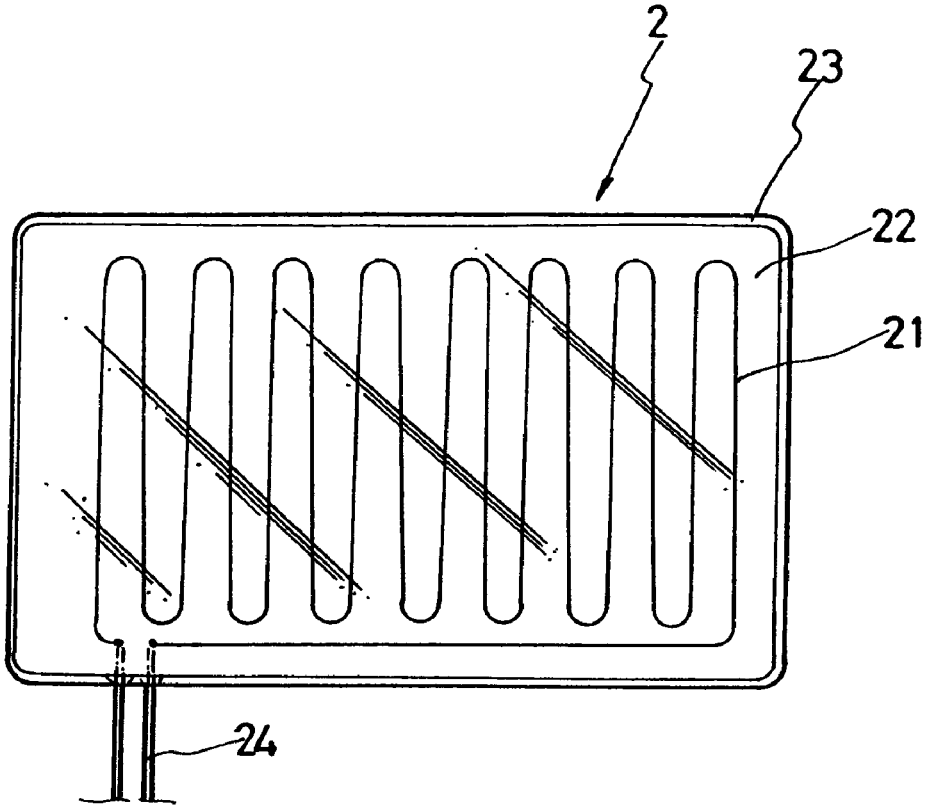
FIG. 5 is a schematic top view showing another layout of the heating wire according to an alternative embodiment of the present invention.

Please refer to FIGS. 1 and 2. An embodiment of the present invention mainly contains an air mattress 1, a blanket member 2, and a mattress cover 3. A heating wire 21 is uniformly layout and embedded inside a cotton blanket 22 of the blanket member 2. The cotton blanket 22 is then wrapped inside an air-tight insulating cover 23, as shown in FIG. 4.

Figure 3:
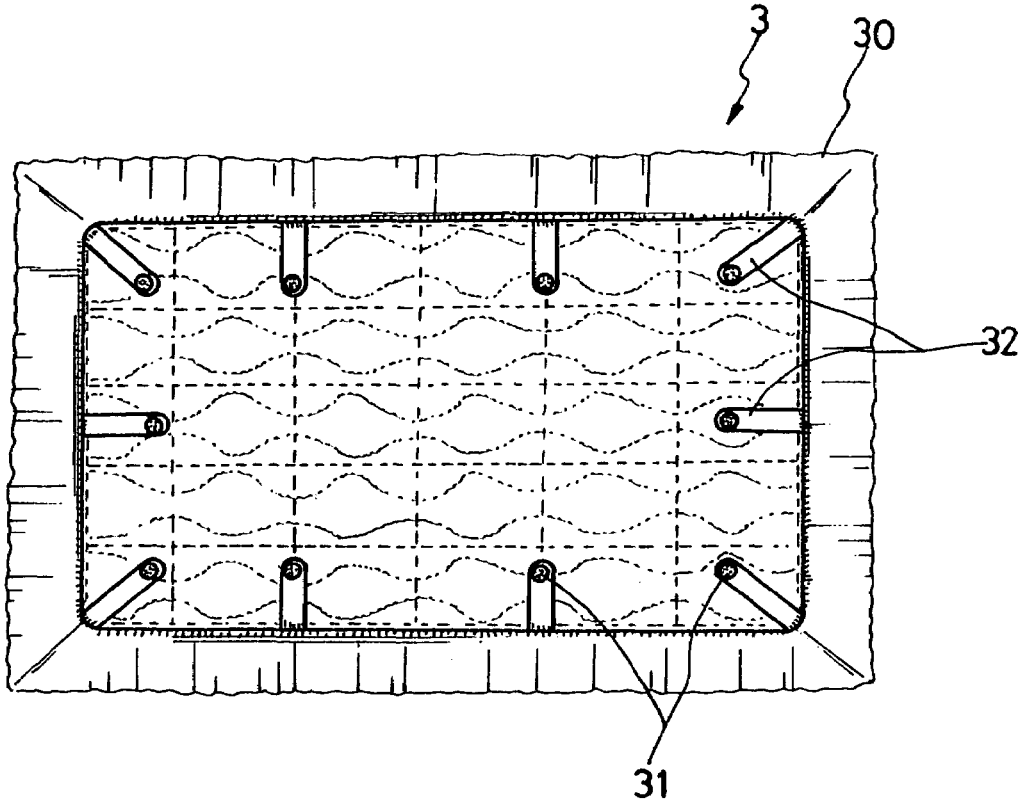
FIG. 3 is a schematic view showing the inside of the mattress cover of FIG. 2.

On a side of the insulating cover 23, a number of snap-on devices 231 are configured along the perimeter, corresponding to a same number of snap-on devices 31 configured on the inside of the mattress cover 3. By attaching the corresponding snap-on devices 31 and 231 together, the blanket member 2 is positioned and adhered to the mattress cover 3. On the other hand, when the blanket member 2 has a smaller dimension than that of the mattress cover 3, the snap-on devices 31 could be configured on extension bands 32 of an appropriate length, elastic or non-elastic, extended from the binding between the top and the ruffle of the mattress cover 3 so that they could be attached to the corresponding snap-on devices 231, as shown in FIGS. 2 and 3.

Please refer back to FIG. 2. The heating wire 21 is connected to a power cable 24 at the perimeter of the blanket member 2. The power cable 24 is in turn connected to a temperature controller 25 capable of both temperature sensing and temperature control so that the temperature of the air mattress 1 could be maintained at a constant level. The layout of heating wire 21 as shown in FIG. 2 is only exemplary. In alternative embodiments, depending on the air mattress is of single size or double size, the layout of the heating wire 21 could be arranged either longitudinally or latitudinally.

Figure 6:
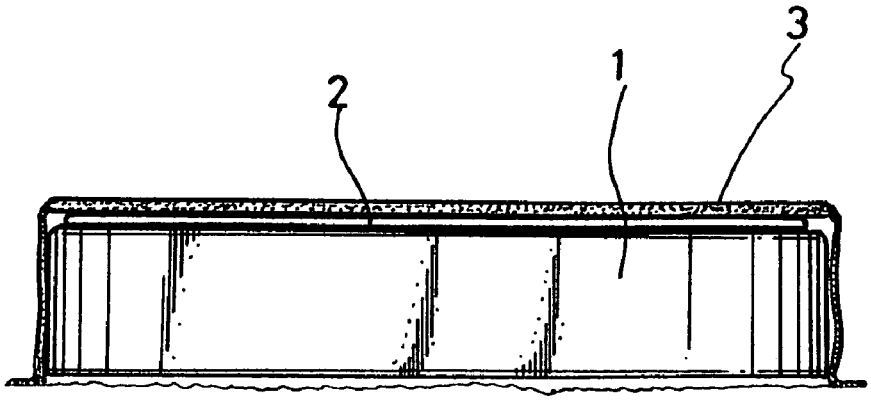
FIG. 6 is a schematic sectional view showing the air mattress assembly of FIG. 2.

Please refer to FIG. 6. The assembly of the present embodiment is first to lay down the blanket member 2 flatly on top of the air mattress 1. The blanket member 2 and the air mattress 1 are then covered by the mattress cover 3 so that the blanket member 2 is sandwiched between the mattress cover 3 and the air mattress 1 and is therefore able to heat up and to keep the warmth of the air mattress assembly.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An air mattress assembly comprising an air mattress, a blanket member, and a mattress cover, wherein:

said blanket member is laid flatly on top of said air mattress; said blanket member comprises a heating wire, a cotton blanket, and an insulating cover; said heating wire is laid out and embedded inside said cotton blanket, said cotton blanket is wrapped air tight inside said insulating cover; a plurality of first snap-on devices are configured on a side and along the perimeter of said insulating cover; and said mattress cover covers said blanket member and said air mattress so that said blanket member is sandwiched therebetween; said mattress cover has a same number of second snap-on devices as said first snap-on device; said plurality of first and second snap-on devices join to each other so as to attach said blanket member to said mattress cover.

2. The air mattress assembly according to claim 1, wherein said heating wire is connected to a power cable at the perimeter of said blanket member; and said power cable is connected to a temperature controller so as to heat up and to control the warmth of said air mattress assembly.

3. The air mattress assembly according to claim 1, wherein said heating wire is laid out either longitudinally or latitudinally.

4. The air mattress assembly according to claim 1, wherein said plurality of second snap-on devices are configured on extension bands extended from binding between the top and ruffle of said mattress cover so that a blanket member of smaller size could be attached to said mattress cover.

* * * * *